US009039311B2

(12) United States Patent
Yokoyama

(10) Patent No.: US 9,039,311 B2
(45) Date of Patent: May 26, 2015

(54) LABEL PRINTER

(71) Applicant: Seiko Epson Corporation, Tokyo (JP)

(72) Inventor: Kazuyuki Yokoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/012,960

(22) Filed: Aug. 28, 2013

(65) Prior Publication Data

US 2014/0037356 A1 Feb. 6, 2014

Related U.S. Application Data

(63) Continuation of application No. 12/170,242, filed on Jul. 9, 2008, now Pat. No. 8,585,304.

(30) Foreign Application Priority Data

Jul. 24, 2007 (JP) ..... 2007-192128

(51) Int. Cl.
*B41J 15/00* (2006.01)
*B41J 15/04* (2006.01)

(52) U.S. Cl.
CPC ..... *B41J 15/042* (2013.01)

(58) Field of Classification Search
CPC ..... B41J 15/00; B41J 15/02; B41J 15/04; B41J 15/042; B41J 3/4075; B65H 26/06; B65H 26/066; B65H 2511/516
USPC ..... 400/613, 611, 613.1, 693, 691, 583
See application file for complete search history.

(56) References Cited

U.S. PATENT DOCUMENTS

| | | | | |
|---|---|---|---|---|
| 2,574,175 | A | 11/1951 | Erhardt | |
| 5,472,153 | A * | 12/1995 | Crowley et al. | 242/420.3 |
| 6,485,210 | B2 * | 11/2002 | Choi | 400/691 |
| 7,404,683 | B2 | 7/2008 | Mochizuki et al. | |
| 2005/0232677 | A1 * | 10/2005 | Ogawa et al. | 400/611 |
| 2005/0232679 | A1 | 10/2005 | Na et al. | |
| 2006/0171754 | A1 | 8/2006 | Takami et al. | |

FOREIGN PATENT DOCUMENTS

| | | | |
|---|---|---|---|
| JP | 57-141055 | U | 2/1981 |
| JP | 56-161933 | A | 12/1981 |
| JP | 60-082567 | A | 5/1985 |
| JP | 07-017095 | A | 1/1995 |
| JP | 2000-264322 | A | 9/2000 |

OTHER PUBLICATIONS

Japanese Office Action 2007-192128 of Dec. 20, 2011 with English translation.

* cited by examiner

*Primary Examiner* — Matthew G Marini
(74) *Attorney, Agent, or Firm* — Kilpatrick Townsend & Stockton LLP

(57) ABSTRACT

A label printer enables drop-in loading of linerless label paper rolls and prevents print defects caused by variation in the label paper transportation and the readhesion of chaff to the label paper. A pair of roll guiding members 37 and 38 limit the position of the outside of the label paper roll 5 to a position separated a predetermined distance from the label paper entrance 11 by contacting the outside of the label paper roll 5 inside the roll paper compartment 7 of the label printer 31 at a position offset from the label paper entrance 11 toward the center of the roll paper compartment 7. The roll guiding members 37 and 38 are members with low friction resistance when in contact with the outside of the label paper roll 5, and thus reduce the friction that can cause inconsistent paper transportation and chaff from wear.

7 Claims, 5 Drawing Sheets

LABEL PRINTER

CROSS-REFERENCES TO RELATED APPLICATIONS

This application is a continuation of U.S. application Ser. No. 12/170,242, filed on Jul. 9, 2008, which claims priority to Japanese Patent Application No. 2007-192128, filed Jul. 24, 2007, the teachings of which are incorporated herein by reference in their entireties and for all purposes.

BACKGROUND OF THE INVENTION

1. Field of the Invention

The present invention relates to a label printer that prints on linerless label paper wound in a roll.

2. Description of Related Art

Label printers for printing labels using linerless label paper have been developed as a way to eliminate the waste created by the liner when printing on label paper with a web liner.

An example of a label printer that can print on such linerless label paper is described next with reference to FIG. 3 and FIG. 4.

The label printer 1 has a roll paper compartment 7, a label transportation path 13, a print head 15, a cover 19, and a case 17. The roll paper compartment 7 holds a label paper roll 5 of linerless label paper 3 wound in a roll. The label transportation path 13 carries the linerless label paper 3 pulled off the label paper roll 5 from a label paper entrance 11 facing the inside of the roll paper compartment 7 to the label paper exit 12. The print head 15 prints on the linerless label paper 3 as it travels through the label transportation path 13. The cover 19 is attached to the case 17 so that it can open and close the roll paper compartment 7 and the label transportation path 13.

The print head 15 is a thermal print head that prints using a thermosensitive printing method.

The linerless label paper 3 has a printing surface that is coated with a thermosensitive layer, and an adhesive coating on the opposite side. The linerless label paper 3 is wound into the label paper roll 5 so that the adhesive side of the linerless label paper 3 is on the inside.

A platen roller 16 that presses the linerless label paper 3 to the print head 15 is disposed at a position opposite the print head 15 with the linerless label paper 3 therebetween. The platen roller 16 is driven rotationally by a drive means not shown, and conveys the linerless label paper 3 to the label paper exit 12 side in conjunction with the printing process.

The label transportation path 13 includes a front transportation guide 21 and a back transportation guide 23. The front transportation guide 21 guides the print side of the linerless label paper 3 from the label paper entrance 11 to the label paper exit 12. The back transportation guide 23 is disposed opposite the front transportation guide 21 and guides the adhesive side of the linerless label paper 3 from the label paper entrance 11 to the label paper exit 12.

The front transportation guide 21 is attached to the case 17 that supports the print head 15, and the back transportation guide 23 and platen roller 16 are attached to the cover 19.

An automatic paper cutter 25 that cuts the linerless label paper 3 discharged from the label paper exit 12 after printing is completed is disposed on the downstream side in front of the label paper exit 12.

The automatic paper cutter 25 cuts the linerless label paper 3 using a cutting blade 26 and a stationary blade 27. The cutting blade 26 can move perpendicularly to the linerless label paper 3, and is disposed to the case 17 on the front transportation guide 21 side. The stationary blade 27 is attached to the cover 19 on the same side as the back transportation guide 23 and platen roller 16.

As shown in FIG. 4, the cover 19 can pivot to the outside on a pin 28 at the bottom of the cover 19, and can thus open the roll paper compartment 7 and the label transportation path 13.

When the cover 19 is open, a label paper roll 5 is set inside the roll paper compartment 7 with a certain length of linerless label paper 3 pulled off the roll, and the cover 19 is then closed, the linerless label paper 3 pulled off the label paper roll 5 inside the roll paper compartment 7 is automatically threaded through the label transportation path 13 and is ready for printing as shown in FIG. 3.

A hollow core 5*a* on which the linerless label paper 3 is wound is in the center of a conventional label paper roll 5, and the roll paper compartment 7 of the label printer 1 generally supports the label paper roll 5 to rotate freely at a fixed position by means of a support shaft passed through the core 5*a*. See, for example, Japanese Unexamined Patent Appl. Pub. JP-A-2000-264322.

A problem with this design in which a support shaft through the core 5*a* of the label paper roll 5 supports the roll to rotate freely is that when the label paper roll 5 is replaced the support shaft must be passed through the core 5*a*. This makes replacing the label paper roll 5 more time consuming. To shorten the time needed to replace the paper, so-called drop-in loading systems that enable the operator to simply drop the label paper roll 5 into the roll paper compartment 7 without using a support shaft have become more common.

When the label paper roll 5 is used in a drop-in loading system, however, the adhesiveness of the adhesive side of the linerless label paper 3 can cause the entire label paper roll 5 to be pulled toward the label paper entrance 11, resulting in the outside of the label paper roll 5 touching multiple places near the label paper entrance 11. As the outside diameter of the label paper roll 5 changes, the contact points on the outside of the label paper roll 5 also change, the friction produced at each point of contact varies, the load changes when the platen roller 16 advances the label paper, and print defects tend to result from the variation in how much the label paper is advanced. When the diameter of the label paper roll 5 becomes particularly small, the label paper roll 5 can become stuck in the label paper entrance 11 and advancing the paper can be temporarily disabled.

When the linerless label paper 3 is pulled into the label transportation path 13, the linerless label paper 3 is peeled from the outside layer of the label paper roll 5 near the label paper entrance 11. This applies a heavy friction load at the label paper entrance 11, and can easily result in build-up of chaff from label paper wear near the label paper entrance 11. This accumulated chaff is then drawn into the label transportation path 13 where it can readhere to the label transportation path 13 and lead to print defects.

SUMMARY OF THE INVENTION

To solve the foregoing problems, a label printer according to the present invention improves the efficiency of replacing the label paper roll by enabling drop-in loading of linerless label paper rolls, suppresses variation in the label paper transportation load that invites variation in the paper transportation distance and thereby prevents print defects caused by variation in the paper transportation distance, and prevents print defects caused by readhesion of chaff to the label paper by suppressing label paper wear caused by a high friction load on the label paper.

A label printer according to a first aspect of the invention has a case, a cover that opens and closes and is attached to the case, a roll paper compartment into which a label paper roll having linerless label paper wound in a roll can be loaded when the cover is open, a label paper entrance that faces the roll paper compartment and through which a leader of linerless label paper pulled of the label paper roll is guided when the cover is closed, and roll guiding members disposed near the label paper entrance.

Further preferably, the label printer also has a print head for printing on the linerless label paper as the linerless label paper is conveyed through a label paper transportation path from the entrance to a label paper exit, and a platen that conveys while pressing the linerless label paper to the print head. The force of the platen conveying the linerless label paper to the label paper entrance is greater than the transportation load of the roll guiding members on the label paper roll.

In this aspect of the invention the force of the platen conveys the linerless label paper toward the label paper entrance to the transportation path. Roll guiding members are provided so that the transportation load of the label paper roll is less than the force of the platen. As a result, linerless label paper can be reliably pulled to the label paper entrance and conveyed to the label paper exit even in a drop-in loading type linerless label paper printer.

Further preferably, the roll guiding members limit the position of the outside of the label paper roll to a position separated a predetermined distance from the label paper entrance by contacting the outside of the label paper roll at two places that are on opposite sides of the origin where the linerless label paper is pulled off the label paper roll at a position separated a predetermined distance toward the roll paper compartment from the label paper entrance.

In this aspect of the invention the roll guiding members contact the outside of the label paper roll and stop the outside of the paper roll at a position separated a predetermined distance toward the center of the roll paper compartment from the label paper entrance, and the outside of the label paper roll therefore does not contact the label paper entrance or other adjacent parts. When the diameter of the label paper roll changes the roll guiding members hold the outside of the label paper roll in the same position, and the point of contact with the outside of the label paper roll does not change as the diameter of the roll changes. More specifically, because the roll guiding members hold the outside surface of the label paper roll loaded in the roll paper compartment in a stable position with substantially constant friction, variation in the paper transportation load that can result in the label paper being conveyed inconsistently can be suppressed and print defects caused by inconsistent paper transportation can be prevented.

In addition, chaff due to friction caused by a high friction load can be suppressed, and print defects caused by the chaff sticking the paper again can be prevented.

Yet further preferably, one of the roll guiding members is disposed on the case side and the other is disposed on the cover side.

With this aspect of the invention the label paper roll is loaded in the roll paper compartment by opening the cover and dropping the paper roll into the open roll paper compartment, thus making replacing the paper roll easy and efficient.

In addition, when the cover is opened to load the label paper roll in the roll paper compartment, the linerless label paper pulled off the label paper roll is pulled to the label paper entrance side of the label transportation path, and the cover is closed, the roll guiding members are automatically positioned on opposite sides of the linerless label paper pulled off the label paper roll. It is therefore not necessary to specifically insert the linerless label paper between the pair of roll guiding members, and the label paper roll can be easily and efficiently replaced.

Furthermore, if the linerless label paper jams inside the label transportation path, opening the cover opens the label transportation path and the pair of roll guiding members, and thus makes recovering from the paper jam simple.

In another aspect of the invention the roll guiding members are guide rollers that contact and rotate freely against the outside of the label paper roll.

When the linerless label paper is pulled through the label transportation path and the label paper roll rotates, the guide rollers touching the outside surface also rotate. The roll guiding members and the outside of the label paper roll therefore do not wear against each other, and variation in the paper transportation load that can cause the paper transportation distance or speed to deviate is suppressed. The label paper can therefore be conveyed at a stable speed, enabling high quality printing.

Furthermore, because wear between the roll guiding members and the outside of the label paper roll is eliminated, chaff from the paper wearing against the point of contact with the roll guiding members can be suppressed, and print defects caused by such chaff readhering to the label paper can be reliably prevented.

Further preferably, the label printer also has at least one guide roller that contacts and rotates freely against the outside of the label paper roll in the roll paper compartment.

The guide roller in this aspect of the invention can therefore receive the label paper roll dropped into the roll paper compartment. Depending upon where the guide roller is placed, this aspect of the invention can accept the label paper roll dropped into the roll paper compartment whether the linerless label printer is placed in a vertical or horizontal orientation.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of a label printer according to the present invention is described below with reference to the accompanying figures.

Figure 1:
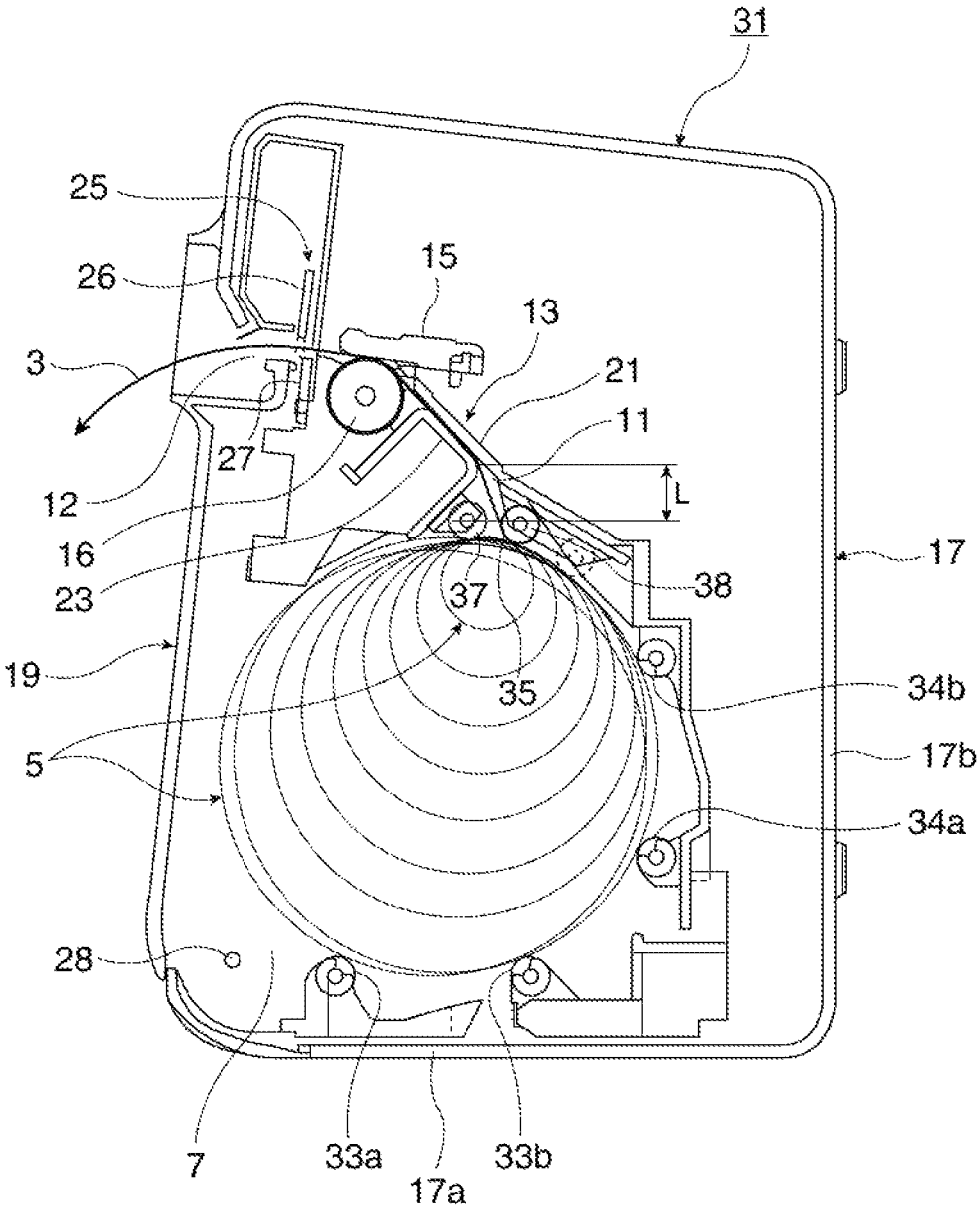
FIG. 1 is a vertical section view schematically showing a label printer according to a preferred embodiment of the invention.
Figure 2:
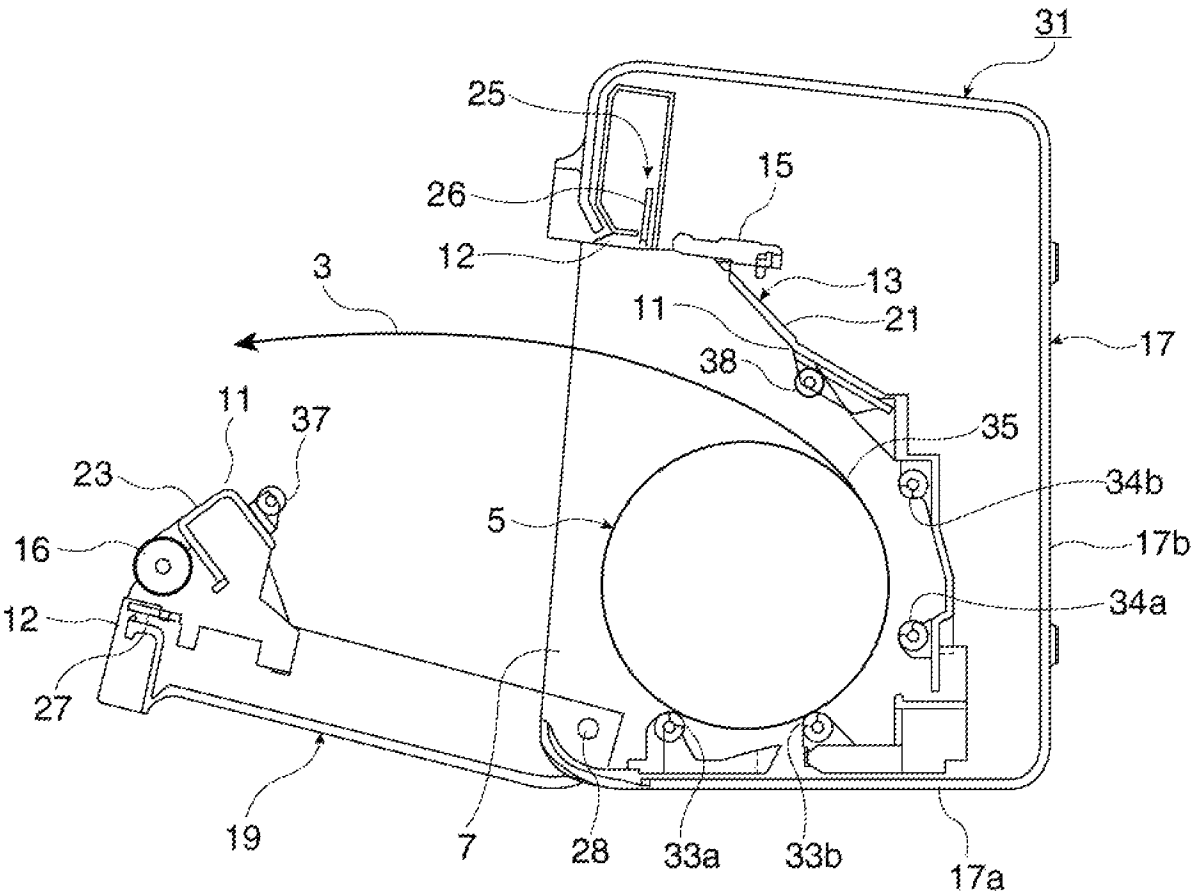
FIG. 2 is a vertical section view of the label printer shown in FIG. 1 with the cover open.
Figure 3:
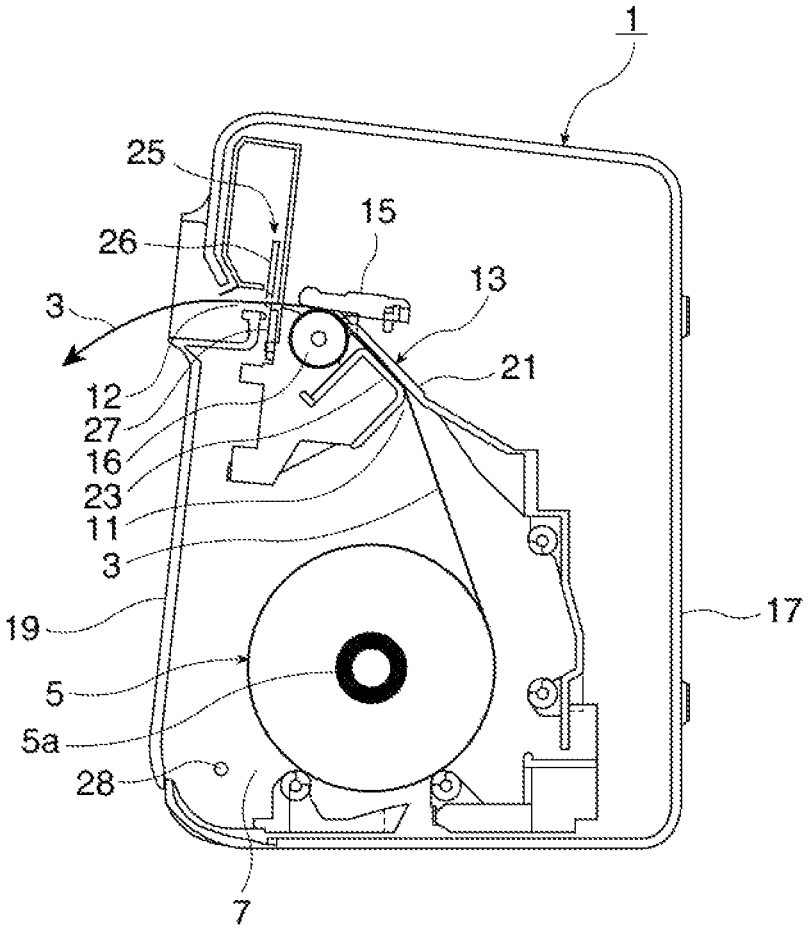
FIG. 3 is a vertical section view schematically showing a label printer according to the related art.
Figure 4:
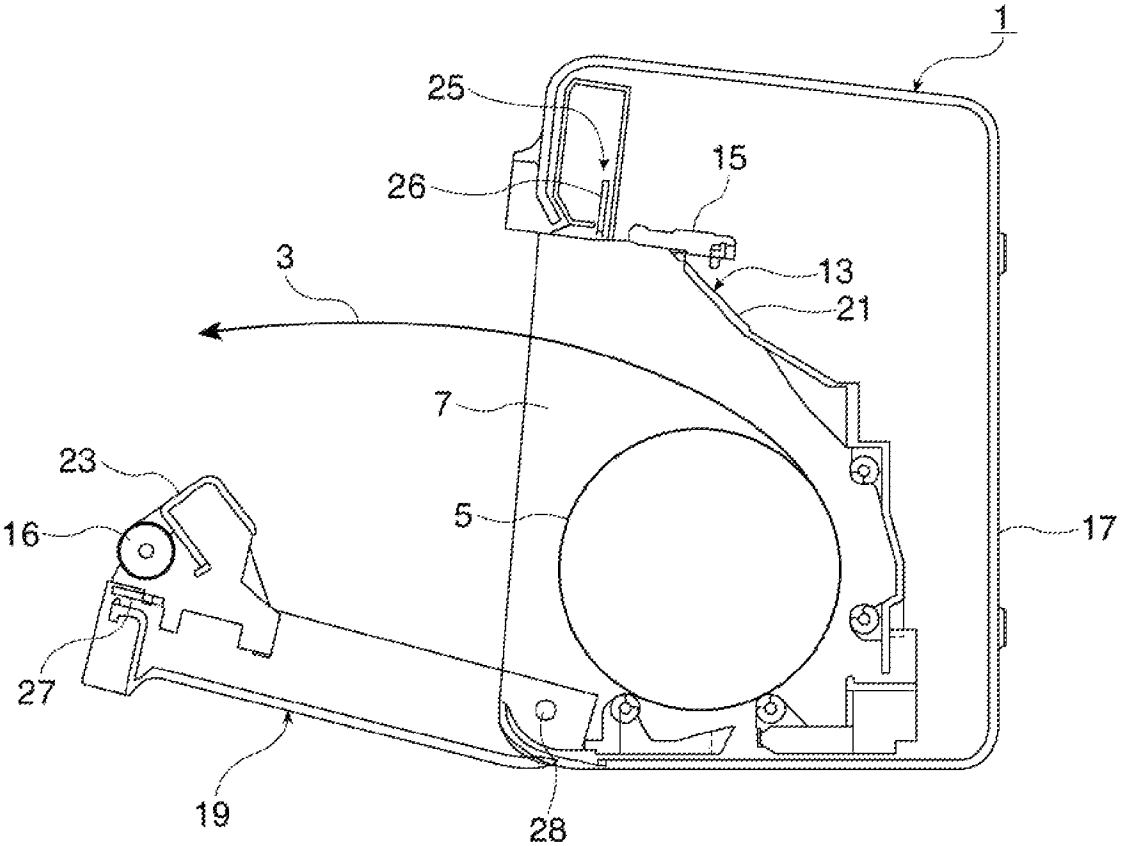
FIG. 4 is a vertical section view of the label printer shown in FIG. 3 with the cover open.
Figure 5:
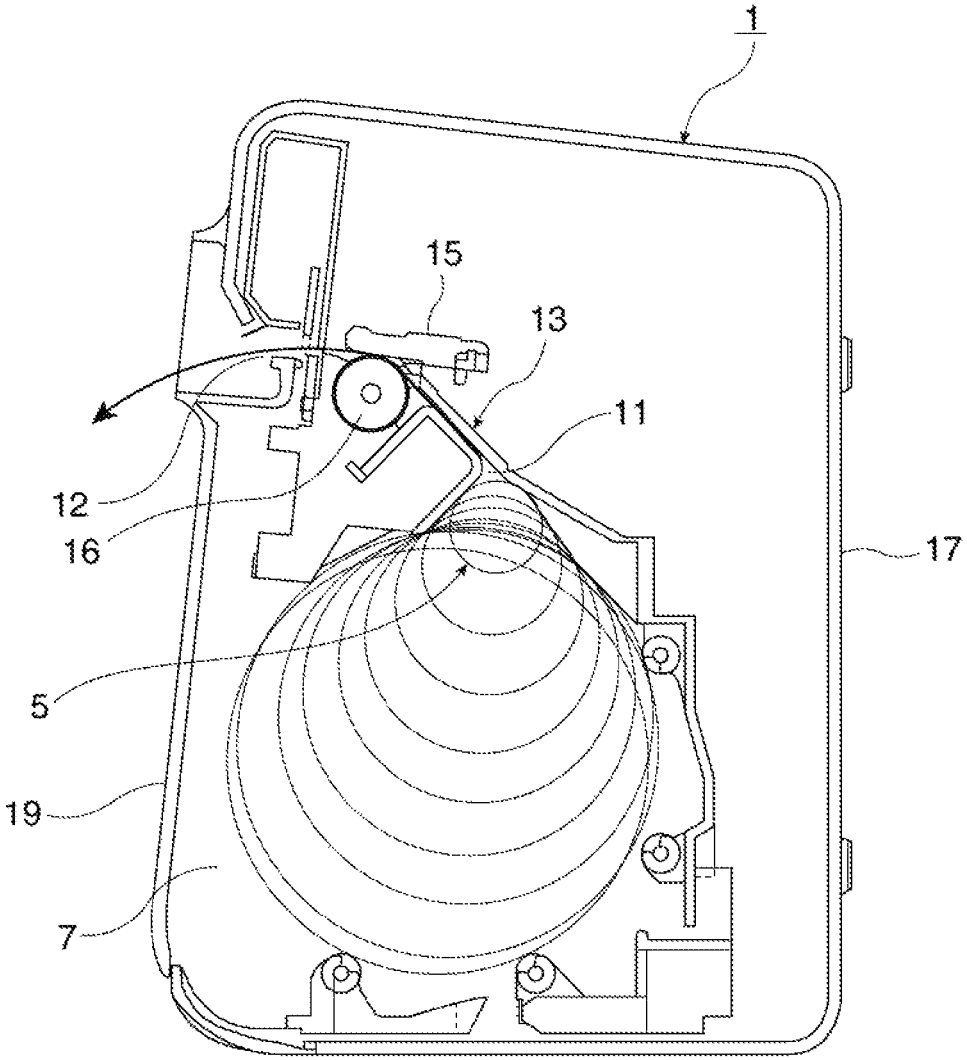
FIG. 5 describes problems that occur with the label printer of the related art when the label paper roll is loaded with a drop-in loading method.

FIG. 1 is a vertical section view schematically showing a label printer according to a preferred embodiment of the invention, and FIG. 2 is a vertical section view of the label printer shown in FIG. 1 with the cover open.

The label printer 31 according to this embodiment of the invention has a drop-in loading type roll paper compartment 7, a label transportation path 13, a print head 15, a cover 19, and a case 17. The roll paper compartment 7 holds a label paper roll 5 of linerless label paper 3 wound in a roll that is simply dropped in to the roll paper compartment 7. The label transportation path 13 carries the linerless label paper 3 pulled off the label paper roll 5 from a label paper entrance 11 facing the inside of the roll paper compartment 7 to the label paper exit 12. The print head 15 prints on the linerless label paper 3 as it travels through the label transportation path 13. The cover 19 is attached to the case 17 so that it can open and close the roll paper compartment 7 and the label transportation path 13.

The print head 15 is a thermal print head that prints using a thermosensitive printing method.

The linerless label paper 3 has a printing surface that is coated with a thermosensitive layer, and an adhesive coating on the opposite side. The linerless label paper 3 is wound into the label paper roll 5 so that the adhesive side of the linerless label paper 3 is on the inside.

A platen roller 16 that presses the linerless label paper 3 to the print head 15 is disposed at a position opposite the print head 15 with the linerless label paper 3 therebetween. The platen roller 16 is driven rotationally by a drive means not shown, and conveys the linerless label paper 3 to the label paper exit 12 side in conjunction with the printing process.

The label transportation path 13 includes a front transportation guide 21 and a back transportation guide 23. The front transportation guide 21 guides the print side of the linerless label paper 3 from the label paper entrance 11 to the label paper exit 12. The back transportation guide 23 is disposed opposite the front transportation guide 21 and guides the adhesive side of the linerless label paper 3 from the label paper entrance 11 to the label paper exit 12.

The front transportation guide 21 is attached to the case 17 that supports the print head 15, and the back transportation guide 23 and platen roller 16 are attached to the cover 19.

An automatic paper cutter 25 that cuts the linerless label paper 3 discharged from the label paper exit 12 after printing is completed is disposed on the downstream side in front of the label paper exit 12.

The automatic paper cutter 25 cuts the linerless label paper 3 using a cutting blade 26 and a stationary blade 27. The cutting blade 26 can move perpendicularly to the linerless label paper 3, and is disposed to the case 17 on the front transportation guide 21 side. The stationary blade 27 is attached to the cover 19 on the same side as the back transportation guide 23 and platen roller 16.

As shown in FIG. 2, the cover 19 can pivot to the outside on a pin 28 at the bottom of the cover 19, and can thus open the roll paper compartment 7 and the label transportation path 13.

When the cover 19 is open, a label paper roll 5 is set inside the roll paper compartment 7 with a certain length of linerless label paper 3 pulled off the roll, and the cover 19 is then closed, the linerless label paper 3 pulled off the label paper roll 5 inside the roll paper compartment 7 is automatically threaded through the label transportation path 13 and is ready for printing as shown in FIG. 1.

The label printer 31 according to this embodiment of the invention has two pairs of roll paper support rollers 33*a*, 33*b* and 34*a*, 34*b* so that the label printer 31 can be used in either a vertical or horizontal orientation.

As shown in the figure, one pair of roll paper support rollers 33*a*, 33*b* support the label paper roll 5 dropped into the roll paper compartment 7 when the label printer 31 is placed resting on the first side wall 17*a* of the case 17 (the vertical orientation).

The other pair of roll paper support rollers 34*a*, 34*b* support the label paper roll 5 dropped into the roll paper compartment 7 when the label printer 31 is placed resting on the second side wall 17*b* of the case 17 in the horizontal orientation (rotated 90 degrees clockwise from the position shown in FIG. 1).

As also shown in FIG. 1, the label printer 31 according to this embodiment of the invention has a pair of roll guiding members 37 and 38 located near the center of the roll paper compartment 7 to contact the outside of the label paper roll 5 at a position separated an appropriate distance L from the label paper entrance 11.

The roll guiding members 37 and 38 contact the outside of the label paper roll 5 at two places on opposite sides of the origin 35 of the linerless label paper 3 as it is pulled off the label paper roll 5 (that is, where the linerless label paper 3 separates from the label paper roll 5), and thus keep the outside of the label paper roll 5 a prescribed distance away from the label paper entrance 11.

The roll guiding members 37 and 38 are members with low friction resistance to the outside of the label paper roll 5, and in this embodiment of the invention are a pair of guide rollers that touch and rotate freely against the outside of the label paper roll 5.

Of the pair of roll guiding members 37 and 38, one roll guiding member 38 is disposed to the case 17 and the other roll guiding member 37 is disposed to the cover 19 in this embodiment of the invention. As shown in FIG. 2, when the cover 19 is opened to expose the roll paper compartment 7, the label transportation path 13 and the roll guiding members 37 and 38 also open at the same time.

To load the label paper roll 5 into the roll paper compartment 7 in the label printer 31 described above, the cover 19 is opened as shown in FIG. 2 and the label paper roll 5 is simply dropped into the open roll paper compartment 7, thereby making replacing the label paper roll 5 easy and efficient.

When the linerless label paper 3 is pulled into the label transportation path 13, the adhesion of the adhesive side of the linerless label paper 3 works on the label paper roll 5 loaded in the roll paper compartment 7 and causes the entire label paper roll 5 to be pulled toward the label paper entrance 11 to the label transportation path 13.

However, because the pair of roll guiding members 37 and 38 contact the outside of the label paper roll 5 and stop the outside of the label paper roll 5 at a position separated a predetermined distance toward the center of the roll paper compartment 7 from the label paper entrance 11, the outside of the label paper roll 5 does not contact the label paper entrance 11 or other nearby parts.

Furthermore, because the pair of roll guiding members 37 and 38 continue to restrict the position of the outside of the label paper roll 5 when the diameter of the label paper roll 5 changes as shown in FIG. 1, the position where the roll guiding members 37 and 38 contact the outside of the label paper roll 5 does not change even if the diameter of the label paper roll 5 changes.

More specifically, because the outside of the label paper roll 5 loaded in the roll paper compartment 7 is held at a stable position by the substantially constant friction of the pair of roll guiding members 37 and 38, variation in the paper transportation load that can cause variation in the paper transportation distance is suppressed, and print defects caused by variation in the paper transportation distance can be prevented.

Furthermore, by using members with low friction resistance against the outside of the label paper roll 5 as the pair of roll guiding members 37 and 38 that control the outside position of the label paper roll 5, chaff produced by a high friction load wearing on the paper can be suppressed, and print defects caused by the chaff sticking to the paper again can be prevented.

As described above, one of the pair of roll guiding members 37 and 38 is disposed to the case 17 and the other is disposed to the cover 19 in the label printer 31 according to this embodiment of the invention so that when the cover 19 is opened to open the roll paper compartment 7 the label transportation path 13 and pair of roll guiding members 37 and 38 also open.

As a result, as shown in FIG. 2, when the cover 19 is opened to load the label paper roll 5 in the roll paper compartment 7, the linerless label paper 3 pulled off the label paper roll 5 is pulled passed the label transportation path 13 to the label paper exit 12, and the cover 19 is closed, the roll guiding members 37 and 38 are automatically positioned on opposite sides of the linerless label paper 3 pulled off the label paper roll 5. It is therefore not necessary to specifically insert the linerless label paper 3 between the pair of roll guiding members 37 and 38, and the label paper roll 5 can be easily and efficiently replaced.

Furthermore, if the linerless label paper 3 jams inside the label transportation path 13, opening the cover 19 opens the label transportation path 13 and the pair of roll guiding members 37 and 38, and thus makes recovering from the paper jam simple.

Yet further, because the pair of roll guiding members 37 and 38 in the label printer 31 according to this embodiment of the invention is a pair of guide rollers that contact and roll freely against the outside of the label paper roll 5, when the linerless label paper 3 is pulled through the label transportation path 13 and the label paper roll 5 rotates, the guide rollers touching the outside surface also rotate. The roll guiding members 37 and 38 and the outside of the label paper roll 5 therefore do not wear against each other, and variation in the paper transportation load that can cause deviation in the paper transportation distance is suppressed. The label paper can therefore be conveyed at a stable speed, enabling high quality printing.

Furthermore, because wear between the roll guiding members 37 and 38 and the outside of the label paper roll 5 is eliminated, chaff from the paper wearing against the point of contact with the roll guiding members 37 and 38 can be suppressed, and print defects caused by such chaff readhering to the label paper can be reliably prevented.

The pair of roll guiding members in the label printer according to the present invention only need to have low friction resistance against the outside surface of the label paper roll 5, and are not limited to rollers as described in this preferred embodiment of the invention. For example, the surfaces that contact the label paper roll 5 could be rendered as guide plates coated with a low coefficient of friction material such as Teflon®.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A label printer configured to house a label paper roll and to print on a label paper pulled off the label paper roll, wherein the label paper pulled off the label paper roll separates from the label paper roll at a separation point, the label printer comprising:

a case;

a cover that opens and closes and is attached to the case;

a roll paper compartment configured to hold the label paper roll without using a support shaft;

a label transportation path configured to guide the label paper pulled off the label paper roll to a label paper exit and to open when the cover is open, wherein the label transportation path comprises:

a first transportation guide member attached to the case and configured to guide a first surface of the label paper;

a second transportation guide member attached to the cover and configured to guide a second surface of the label paper;

a label paper entrance formed by the first transportation guide member and the second transportation guide member when the cover is closed;

a roll guiding member disposed on the second transportation guide member and configured to contact an outside surface of the label paper roll upstream of the separation point, wherein the roll guiding member is configured to restrict a position of the label paper roll upstream of the separation point, and the roll guiding member is at a stationary fixed position with respect to the second transportation guide member, such that the position of the roll guiding member with respect to the second transportation guide member does not change when a diameter of the label paper roll changes; and a print head attached to the case and configured to print the first surface of the label paper.

2. The label printer described in claim 1, wherein the roll guiding member keeps the label paper roll upstream of the separation point a prescribed distance away from the label paper entrance and prevents the label paper roll upstream of the separation point from contacting the label paper entrance or the second transportation guide member.

3. The label printer described in claim 1, wherein the second surface of the label roll paper is adhesive.

4. The label printer described in claim 1, further comprising: a second roll guiding member disposed on the case and configured to contact the outside surface of the label paper roll upstream of the separation point.

5. The label printer described in claim 4, further comprising: a platen configured to press the label paper to the print head, wherein a force of the pressing of the platen is greater than a transportation load of the roll guiding member and the second roll guiding member on the label paper roll.

6. The label printer described in claim 1, wherein the roll guiding member is a guide roller that rotates against the outside surface of the label paper roll upstream of the separation point.

7. The label printer described in claim 1, further comprising: a pair of roller support rollers configured to support the label paper roll in the roll paper compartment.

* * * * *